United States Patent [19]

Rew et al.

[11] 4,135,298

[45] Jan. 23, 1979

[54] DEFORMABLE HEAT TRANSFER FIN

[75] Inventors: James A. Rew, Glen Burnie; Albert B. Simon, Ellicott City; Thomas M. Fahey, Laurel, all of Md.

[73] Assignee: The United States of America as represented by the Secretary of the Air Force, Washington, D.C.

[21] Appl. No.: 808,493

[22] Filed: Jun. 21, 1977

[51] Int. Cl.[2] ..... B23P 15/26

[52] U.S. Cl. ..... 29/727; 29/157.3 V; 29/421 R; 29/455 R; 29/523

[58] Field of Search ..... 29/727, 421 R, 157.3 V, 29/523, 455 R

[56] References Cited

U.S. PATENT DOCUMENTS

| | | | |
|---|---|---|---|
| 2,487,257 | 11/1949 | Morgan | 29/421 |
| 2,693,026 | 11/1954 | Simpelaar | 29/523 |
| 3,173,196 | 3/1965 | Grimm | 29/421 X |
| 3,623,204 | 11/1971 | Wagle | 29/157.3 V X |
| 3,636,607 | 1/1972 | DeMarco | 29/523 X |

*Primary Examiner*—Victor A. DiPalma
*Attorney, Agent, or Firm*—Joseph E. Rusz; Arsen Tashjian

[57] ABSTRACT

A mechanically deformable heat transfer fin for installation in a hollow cavity of a large complex elongated extrusion to improve heat transfer characteristics without brazing welding or glueing. Since the required design cannot be obtained with the transfer fins as an integral part of the extrusion using presently known techniques, a separate fin insert of slightly smaller dimensions than the hollow opening of the large extrusion is installed therein. The insert includes a plurality of legs and an internal pressure cavity which can be sealed off at both ends with pressure cap fittings secured by tie rods. After installation in the extrusion, pressure is applied to the inner chamber until the legs of the insert move outward and contact the inner surface of the extrusion walls. The pressure is raised until the relatively thin walls of the insert are permanently deformed so that, when the pressure is relieved, the insert is held fixedly in place.

2 Claims, 3 Drawing Figures

DEFORMABLE HEAT TRANSFER FIN

STATEMENT OF GOVERNMENT INTEREST

The invention described herein may be manufactured and used by or for the Government for governmental purposes without the payment of any royalty thereon.

BACKGROUND OF THE INVENTION

This invention relates to a mechanically deformable heat transfer fin and, more particularly, the invention is concerned with providing a heat transfer fin that can be installed against surfaces to improve heat transfer characteristics of an extrusion member without brazing, welding or glueing.

Heretofore, it has been common practice to produce certain very complex large elements by the extrusion process. This applies especially to members having channels through which cooling fluids are circulated. It is, of course, fundamental in cooling systems to provide a large surface area from which the heat can be transferred. However, structures formed by extrusion are limited as to their complexity and size because of the inherent limitations of the process. In the particular structure of the present invention, it was found that the required design and shape was unattainable by extrusion using dies and techniques presently available. Consequently, it was found to be necessary to produce the structure as a separate extrusion and heat transfer fin and then join them in a single unit. The technique for joining the two elements necessitates the close, intimate contact therebetween so that heat transfer can take place efficiently. Generally, this would require welding or brazing which is a time consuming process that can be difficult with metals such as aluminum. Glueing is also utilized to provide close contact between the elements but this attachment can be weakened and fail after repeated thermal changes in the elements joined.

In the hereinafter described invention, the heat transfer fin and the extrusion element are joined mechanically without the use of brazing or welding and without the need for glueing. It is easy to see that many advantages gained by the elimination of the present requirements for assembling the heat transfer fins to the extrusion elements in the manner outlined.

SUMMARY OF THE INVENTION

The present invention is concerned with providing a technique for attaching a heat transfer fin to a larger extrusion to allow good heat transfer from the large extrusion into the heat transfer fin. The fin is slightly smaller than the hollow opening in the large extrusion so that it can be easiy installed therein. Pressure cap fittings with rubber gaskets are secured with tie rods to seal off the inner chamber of the fin insert. The insert is positioned in the large hollow extrusion and then pressure is applied to the inner chamber of the insert. Legs which extend from the wall of the inner chamber move outward and contact the inner wall of the hollow extrusion. The pressure is raised to approximately 400 to 500 psi and thin walled corners on the inner chamber permanently deform causing the insert to remain fixed in place after the pressure is relieved.

Accordingly, it is an object of the invention to provide a deformable heat transfer fin suitable for use with a large complex extrusion.

Another object of the invention is to provide a deformable heat transfer fin wherein no welding or brazing is required to attach the fin to the structure being cooled.

Still another object of the invention is to provide a deformable heat transfer fin wherein the fin is held in position in a large hollow extrusion by residual pressure from the fin itself.

A further object of the invention is to provide a deformable heat transfer fin suitable for insertion into a hollow extrusion and having an internal pressure cavity which can be pressurized causing legs extending therefrom to press against the inner wall of the extrusion and thereby become firmly attached thereto.

A still further object of the invention is to provide a deformable heat transfer fin having a square internal cavity with thin-walled corners which become permanently deformed when sufficient pressure is applied causing the fin to remain fixedly in position in the extrusion.

These and other objects, features and advantages will become mcre obvious after considering the following description taken in conjunction with the annexed drawings and appended claims.

DESCRIPTION OF A PREFERRED EMBODIMENT

Figure 1:
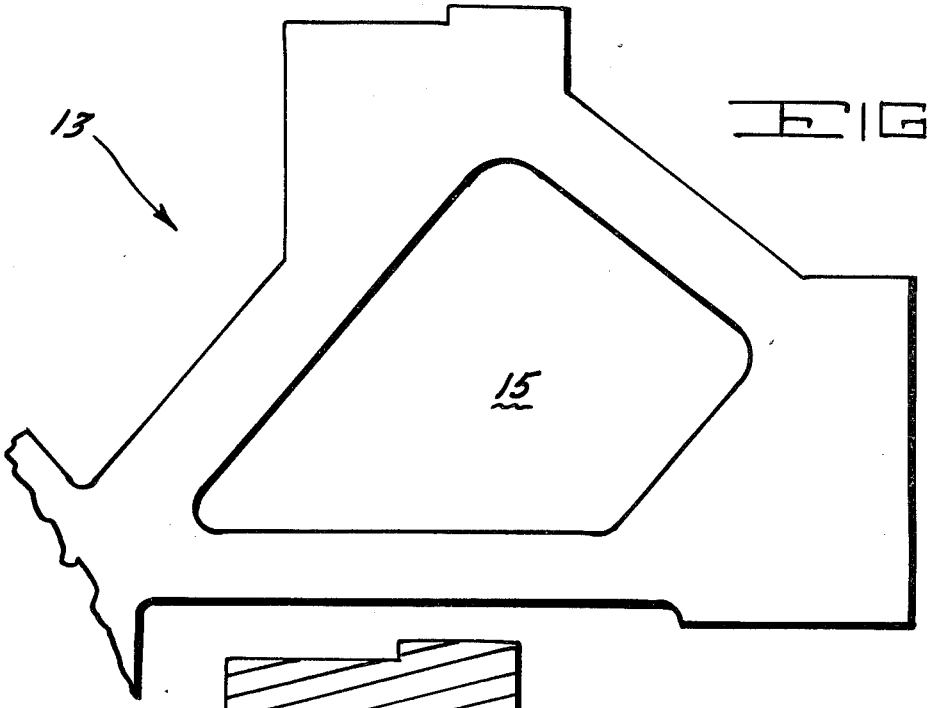
FIG. 1 is a view in cross section of the large hollow extrusion showing the central area in which the deformable heat transfer fin is installed.
Figure 2:
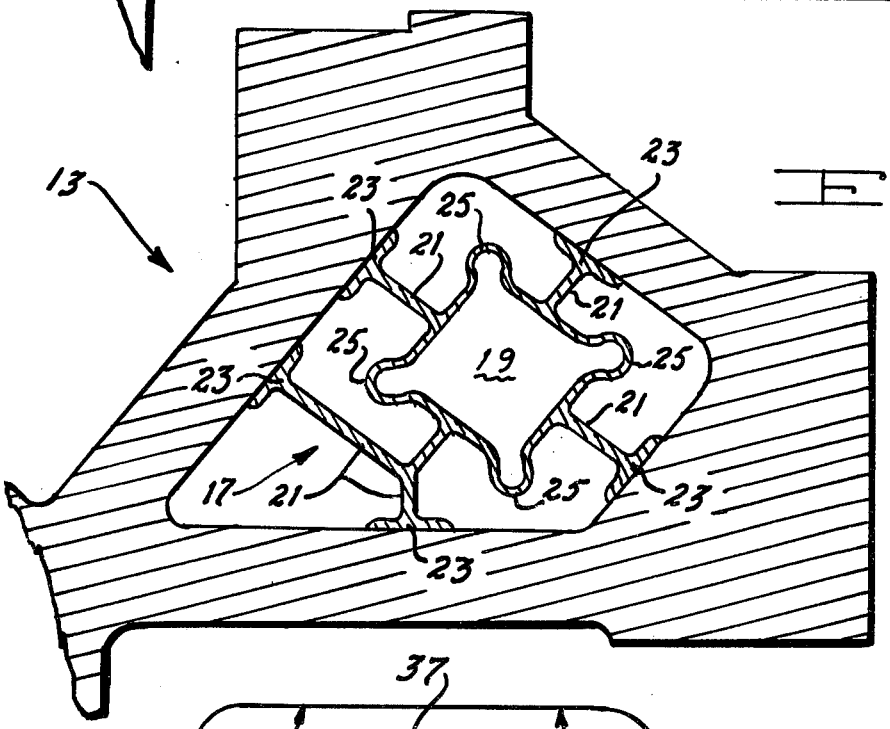
FIG. 2 is a view in cross section of the hollow extrusion with the deformable heat transfer fin according to the invention installed therein.
Figure 3:
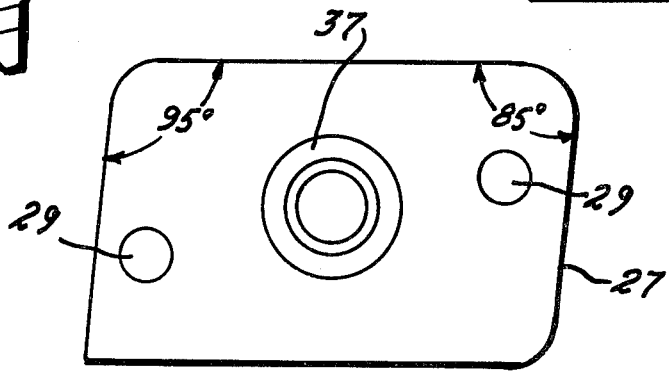
FIG. 3 is a view of one of two pressure cap fittings which are secured to each end of the extrusion with the heat transfer fin installed to seal off the inner chamber of the insert during the pressurizing procedure.

Referring now to the drawing wherein like reference numerals refer to like elements in each of the views, the primary structure is a very complex, large extrusion 13 shown in cross section in FIG. 1. It is necessary to provide means for cooling the structure 13, preferably by carrying away the heat from the internal cavity 15. It was found that the required design and shape necessary to effectively cool the structure 13 was unattainable by extrusion using dies and techniques presently available. Therefore, a small extrusion in the form of the deformable heat transfer fin 17 was fabricated and installed in the internal cavity 15 of the extrusion 13 (see FIG. 2). The heat transfer fin 17 includes a square inner chamber 19 which functions as an internal pressure cavity. A plurality of legs 21 extend outwardly from each side of the square inner chamber 19 and include feet 23 which contact the inner wall of the internal cavity 15 of the extrusion 13. The square inner chamber 19 includes rounded, thin-walled corners 25 which are deformed when suitable internal pressure is applied to the chamber 19. The heat transfer fin 17 is slightly smaller than the hollow opening in the extrusion 13 so that it can be easily installed therein. A pressure cap fitting 27 shown in FIG. 3 with rubber gaskets (not shown) is placed at each end of the extrusion 13 with the heat transfer fin 17 in place in the internal cavity 15. Tie rods (not shown) pass through the holes 29 and secure the pressure cap fittings 27 to seal off the inner chamber 19 of the heat transfer fin 17. A boss 37 is mounted on one of the pressure cap fittings for attachment of the pressurizing means thereto.

In operation, after the fin 17 is positioned in the extrusion 13, pressure in the form of compressed air, for example, is applied to the inner chamber 19 by any suitable means such as an air compressor or other compressed air source. The legs 21 with the feet 23 attached thereto move outward until they contact the surface of the internal cavity 15 of the extrusion 13. The pressure is raised to approximately 400 to 500 psi causing the thin-walled corners 25 of the square inner chamber 19 to permanently deform so that when the pressure is relieved, the fin 17 is held solidly in place.

From the foregoing description, it can be seen that by eliminating the need for brazing or welding, which is itself a time consuming operation, the need for complicated heat treatment and straightening operations are also eliminated. No complex fixturing is required for assembling the fin in the extrusion member. Installation of the fin in the manner hereinbefore described is extremely fast, inexpensive, requires no elaborate locating fixtures and yields very good thermal characteristics which can be tailored to the application by adhesives or coatings on the contact feet of the fin insert.

Although the invention has been illustrated in the accompanying drawings and described in the foregoing specification in terms of a preferred embodiment thereof, the invention is not limited to this embodiment or to the preferred configuration shown. It will be apparent to those skilled in the art that our invention could have extensive use in other operations where it is necessary to install a thin-walled element inside a cavity so that no relative movement would occur. The invention is especially useful where the element having the cavity is some substance which cannot be readily welded or brazed.

Having thus set forth the nature of our invention, what we desire to secure by Letters Patent of the United States is:

1. In combination, an elongated extrusion member having a longitudinal internal cavity therein for passage of a cooling fluid therethrough and a deformable heat transfer fin slightly smaller in size than the internal cavity of said extrusion member for installation therein and means for fixedly positioning said heat transfer fin in said internal cavity comprising a square inner chamber in the central portion of said heat transfer fin, said square inner chamber having rounded thin-walled corners, a plurality of legs extending outwardly from each side of said square inner chamber, a corresponding plurality of feet on the outward end of each of said legs and means for pressurizing said square inner chamber whereby pressure of sufficient magnitude is applied to the square inner chamber of said heat transfer fin to permanently deform the rounded thin-walled corners of said square inner chamber leaving a residual stress in said heat transfer fin after the pressure is relieved causing the feet to press against the wall of the internal cavity of said extrusion member thereby fixedly positioning said heat transfer fin in the internal cavity of said extrusion member.

2. The combination extrusion member and deformable heat transfer fin defined in claim 1 wherein the means for pressurizing the square inner chamber of said heat transfer fin includes a pressure cap fitting attached to each end of the extrusion chamber with the heat transfer fin installed therein, one of said pressure cap fittings having a boss in the central portion thereof for attachment of a pressure source thereto, and means for holding said pressure cap fitting against each end of said extrusion member making the inner chamber of said heat transfer fin air tight.

* * * * *